United States Patent [19]

Tomaka et al.

[11] Patent Number: 4,953,473

[45] Date of Patent: Sep. 4, 1990

[54] COMBINATION SERVING TRAY, BED TRAY AND BATHTUB TRAY

[76] Inventors: Leonard P. Tomaka, #4817 175 E. Delaware Pl.; Larry M. Dreyfus, #4819 175 E. Delaware Pl., both of Chicago, Ill. 60611

[21] Appl. No.: 466,770

[22] Filed: Jan. 18, 1990

[51] Int. Cl.[5] ..... A47B 3/00

[52] U.S. Cl. ..... 108/132; 108/129; 108/127; 248/439; 16/115; 206/557

[58] Field of Search ..... 206/557; 108/14, 44, 108/118, 127, 129, 132, 133; 248/166, 170, 439; 16/115; 297/53, 54, 188, 194

[56] References Cited

U.S. PATENT DOCUMENTS

| | | | |
|---|---|---|---|
| 823,699 | 6/1906 | Roemer . | |
| 1,138,156 | 5/1915 | Stroud . | |
| 1,257,843 | 2/1918 | Gonyea . | |
| 1,567,045 | 12/1925 | Ebel . | |
| 1,709,928 | 4/1929 | Whitney . | |
| 2,542,394 | 2/1951 | Cohen et al. | 108/132 |
| 2,758,899 | 8/1956 | Smith et al. | 108/132 |
| 2,823,087 | 2/1958 | Zimmer | 108/132 |
| 2,986,438 | 5/1961 | Smathers et al. | 108/132 |
| 4,010,696 | 3/1977 | Priesman | 108/19 |
| 4,053,954 | 10/1977 | Chapman | 4/185 AB |
| 4,144,822 | 3/1979 | Roberts et al. | 108/129 |
| 4,254,850 | 3/1981 | Knowles | 16/115 |
| 4,557,200 | 12/1985 | Geschwender | 248/439 |
| 4,756,119 | 7/1988 | Chabot | 248/439 |

FOREIGN PATENT DOCUMENTS

| | | | |
|---|---|---|---|
| 2539688 | 3/1976 | Fed. Rep. of Germany | 108/129 |
| 2415985 | 10/1979 | France | 248/439 |

*Primary Examiner*—David T. Fidei

*Attorney, Agent, or Firm*—Clement and Ryan

[57] ABSTRACT

A combination serving tray, bed tray and bathtub tray. A "U-shaped" leg is hinged at each end of an elongated tray, to swing from a closed position underneath the tray frame down into a generally upright position. In this position, the legs hold the tray a predetermined height above the surface on which the legs are supported. A cammed latch is provided beneath the bottom surface of the tray, positioned to engage the resiliently bendable bight portion of each "U"-shaped leg when the leg is swung up from its open position to its closed position. Handles are provided at each end of the tray, slidably engaged with the tray frame and movable outward a predetermined maximum distance but no farther. In its preferred form, the cammed latch includes a spherical body that engages the resiliently bendable bight portions of the "U"-shaped legs to hold them in their closed positions.

17 Claims, 2 Drawing Sheets

Fig. 7
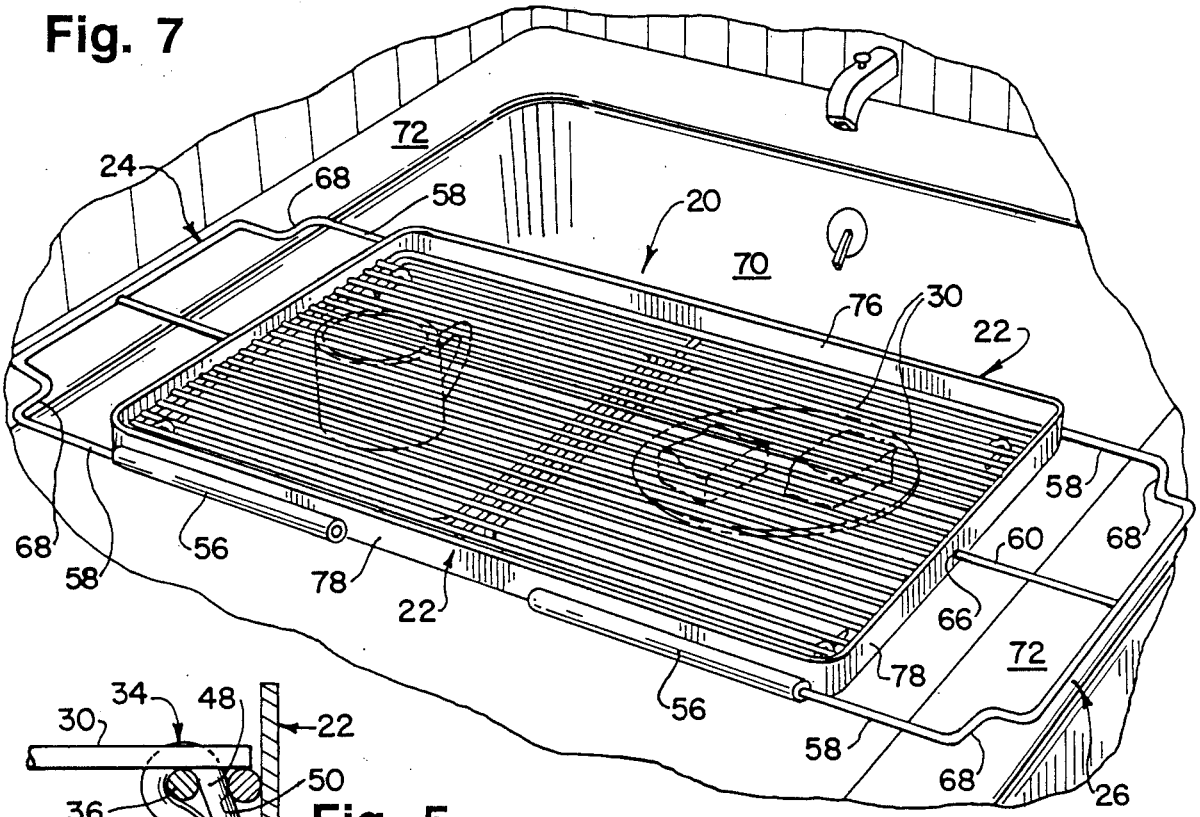
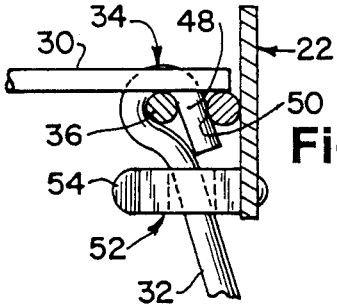
Fig. 5
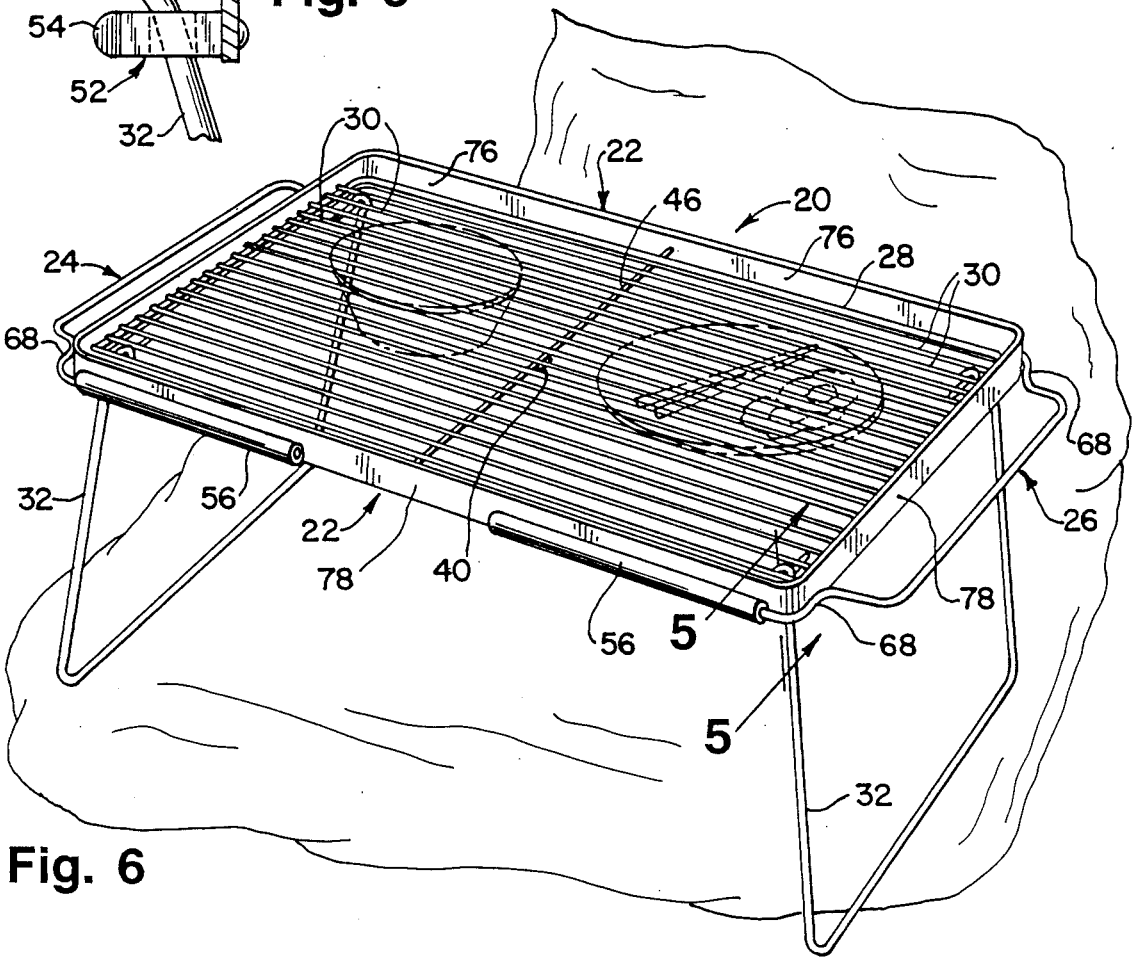
Fig. 6

COMBINATION SERVING TRAY, BED TRAY AND BATHTUB TRAY

FIELD OF INVENTION

This invention relates to a folding tray, and more particularly to a combination serving tray, bed tray and bathtub tray.

BACKGROUND OF THE INVENTION

Folding trays that can serve either as a conventional serving tray or as a bed tray, whichever the user desires, have been known for many years. Certain types of bathtub trays have also been known. However, no folding tray that combines all three functions, as the present invention does, is disclosed in the prior art.

Moreover, the mechanisms of the folding trays of the types disclosed in prior art U.S. Pat. Nos. 1,138,156 and 1,709,928 to produce folding legs have been unnecessarily complicated. The hinged legs disclosed in U.S. Pat. No. 823,699 are of simple construction, but do not have completely out-of-way positions, nor are they held securely against accidental displacement from the partially closed positions they do have underneath the tray.

Trays adapted solely for use as bathtub trays are either positioned too high above the sides of the tub to be convenient for the user when seated in the tub (as in U.S. Pat. No. 1,567,045), or are not extensible (as in U.S. Pat. No. 4,053,954). If an attempt were made to use the extensible tray of U.S. Pat. No. 1,257,843 as a bathtub tray, the tray would again be positioned too high above the side walls of the tub for the convenience of the user, and would in addition not rest securely upon the tub side walls.

The tray of the present invention avoids these shortcomings of prior art trays, as well as providing a novel combination of a serving tray, bed tray and bathtub tray.

SUMMARY OF THE INVENTION

The device of this invention includes an elongated tray that provides a support surface extending from end to end, and from side to side, of the tray. Objects such as plates, cups and saucers, glasses, bottles and the like are supported thereby when the tray is in use.

Each end of the tray carries a "U"-shaped hinged leg. The leg is hinged to swing from a closed position located underneath the tray frame, in which position the leg is substantially parallel to the bottom surface of the support member, downward into a vertical position and then beyond into an over-center open position, in which position the leg is generally upright. Each "U"-shaped leg has a bight portion that is normally stiff, but is resiliently bendable under pressure.

A stop is provided for each "U"-shaped leg, which limits the leg from moving beyond its over-center, open, generally upright position. In this position the two "U"-shaped legs hold the tray at a predetermined height above the surface on which the legs are supported.

An important feature of the tray of this invention is the cammed latch located beneath the tray. The latch includes a camming surface facing each end of the tray, in a position to engage the bight portion of one of the "U"-shaped legs when the leg is swung from its open position and nears its closed position. Each camming surface is configured to bend the resiliently bendable bight portion of the leg with which it is associated as the bight portion (1) is pushed by the user of the tray toward the bottom of the support member, (2) slides across the camming surface, and (3) after riding over the camming surface, snaps back to its normal shape to hold the leg in its closed position beneath the tray.

A handle extends outward at each end of the elongated tray. Each handle is slidably engaged with the tray so as to be movable outward into an open position at a predetermined distance from the end of the tray. The width of each handle is equal to a substantial portion of the width of the tray—desirably at least about one-quarter, better at least about one-half, and preferably at least about three-quarters, of the tray width.

A stop is associated with each handle. The stop prevents its associated handle from moving outward more than the predetermined maximum distance and separating itself completely from the elongated tray. This stop eliminates the safety hazard that would be created if the handle could be pulled entirely apart from the tray.

When the handles are pushed inward into their closest positions to the tray, the tray is in condition to be used either as a conventional serving tray, or as a bed tray after the "U"-shaped legs are swung down into their over-center, open, generally upright positions. In either of these conditions the tray can, if desired, also be used as a picnic tray, TV tray or buffet server. When one or both of the handles are pulled outward a distance equal to part or all of the maximum predetermined distance, the tray is in condition to be used as a bathtub tray, with the handles resting on the side walls of the tub.

Preferred forms of the cam latch and the handles are disclosed.

In addition, a pressure-actuatable stop means is disclosed that may be used to hold a "U"-shaped leg in its open, generally upright position and, when desired, to release the legs under pressure that is applied by the user directed towards the center of the elongated tray.

In addition to the overall combination, the subcombination of a combination serving tray and bed tray with the cammed latch described above is claimed.

BRIEF DESCRIPTION OF THE DRAWING

The invention will now be more fully described in connection with the accompanying drawing, in which:

FIG. 5 is a similar sectional view taken along the line 5—5 in FIG. 6, showing the "U"-shaped leg limited to its over-center, open, generally upright position by its associated stop means, and further showing a pressure-actuatable stop to hold the leg releasably in that open position.

FIG. 6 is a three-quarters perspective view of the combination tray of FIG. 1 used as a bed tray, with a plate and bowl shown on the tray in phantom.

FIG. 7 is a three-quarters perspective view of the combination tray of FIG. 1 showing the tray in use as a bathtub tray, with a plate and cup shown on the tray in phantom.

DETAILED DESCRIPTION OF SPECIFIC EMBODIMENT OF THE INVENTION

Figure 1:
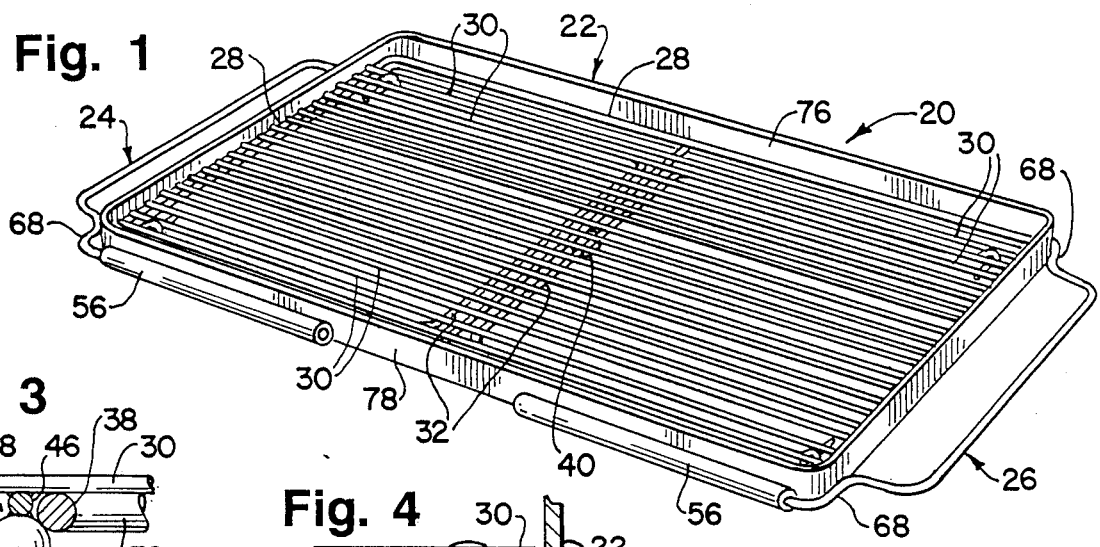
FIG. 1 is a three-quarters perspective view of one embodiment of the combination tray of this invention in condition to be used as a serving tray, with a plate shown in phantom resting on the tray.

FIG. 1 shows a three-quarters perspective view of combination serving tray, bed tray and bathtub tray 20 in condition for use as a conventional serving tray.

Basic Tray Construction

Elongated tray frame 22 extends around the perimeter of the tray. Handles 24 and 26, which will be described in more detail below, extend away from the ends of the elongated tray in the closed positions shown in FIGS. 1 and 6, and when desired are further extensible into the open positions shown in FIG. 7.

In the embodiment shown, tray frame 22 is formed of a strap-shaped material. A light metal, a rigid plastic, or any other suitable material may be used for the frame.

Base rod 28 is secured to the inner surface of tray frame 22 around the perimeter of the frame. In this embodiment, an array of parallel, spaced wires is attached to base rod 28, extending from one end to the other, and from one side to the other, of the tray. This array of wires provides a support surface for objects to be placed on the tray.

Any other suitable construction that provides such a support surface may of course be utilized.

Hinged Legs

Figure 2:
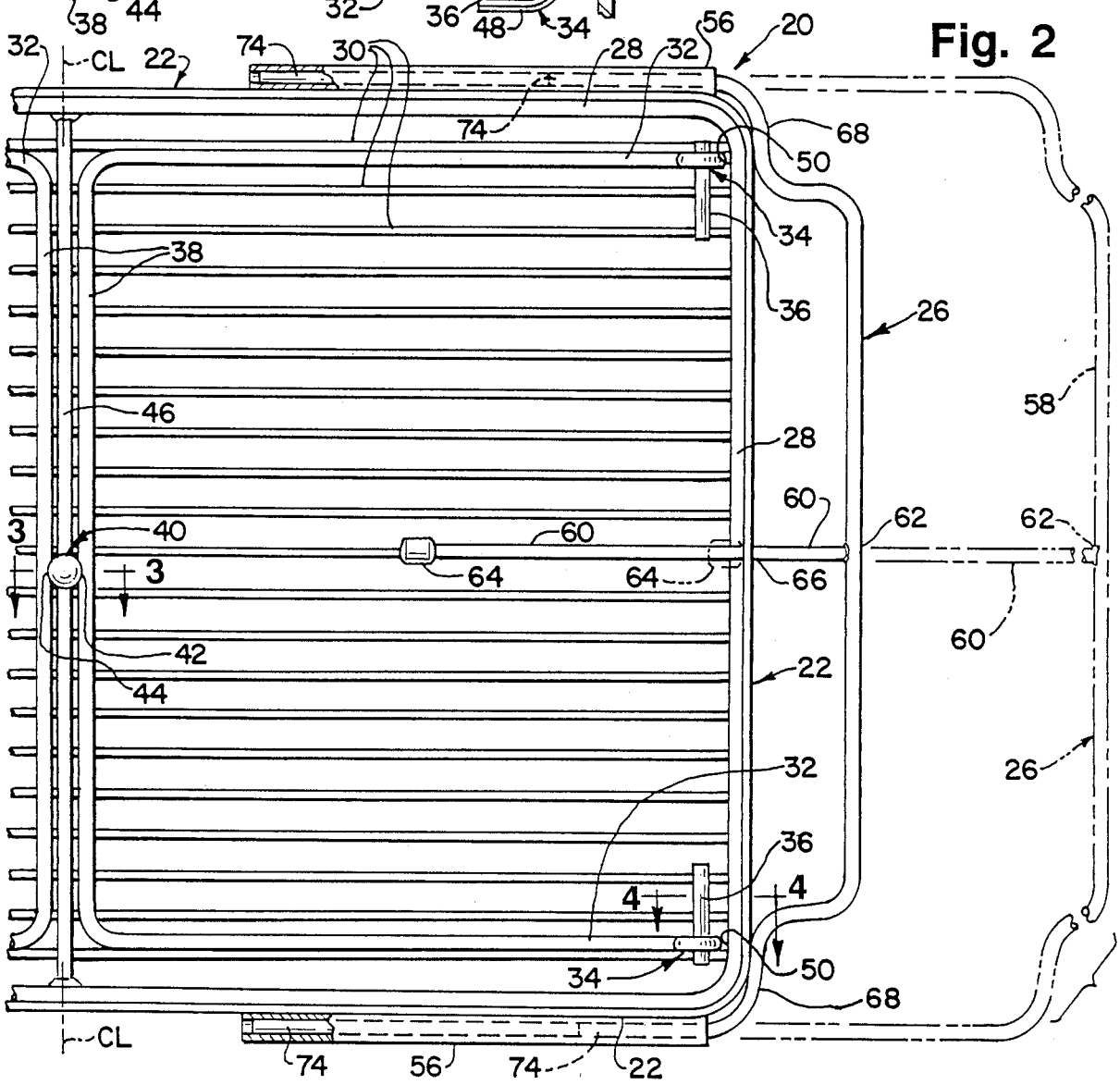
FIG. 2 is a fragmentary plan view of the combination tray of FIG. 1, showing a handle in full lines at one end of the tray in its closed position, and in dashed lines in its maximum extended position.

With the tray in the condition shown in FIG. 1, the legs that make the tray a combination serving tray and bed tray are partially obscured. FIG. 2, a fragmentary bottom plan view of the tray of FIG. 1, gives a clearer showing of the legs.

A "U"-shaped leg 32 is hinged at 34 at each end of elongated tray frame 22. In the embodiment shown, hinge pins 36 are secured to a plurality of spaced, parallel wires 30 that are part of the array of wires that forms the support surface on the tray.

Figure 4:
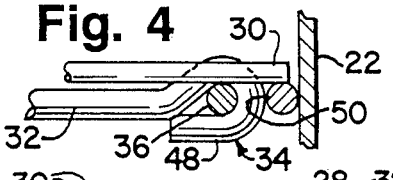
FIG. 4 is a fragmentary sectional view taken along the line 4—4 in FIG. 2, showing the hinge of the "U"-shaped leg that is on the right-hand side of FIG. 3, together with the stop means that limits the leg to its over-center, open, generally upright position.

FIG. 5 is a fragmentary sectional view taken along line 5—5 in FIG. 6. It shows leg 32 after it has been swung downward from its position shown in FIGS. 1, 2 and 4 into a vertical position and then beyond into the over-center, open, generally upright position shown. In this position, end portion 48 of hinge 34 abuts a portion 50 of base rod 28. Rod portion 50 acts as a stop for "U"-shaped leg 32, and limits the leg from moving beyond its over-center, open, generally upright position. With both "U"-shaped legs in this position, tray 20 is held at a predetermined height above the surface on which the legs are supported, in the manner illustrated in FIG. 6.

FIG. 5 also shows a pressure-actuatable stop means 52, which may be included in the combination tray of this invention if it is desired to hold the "U"-shaped legs of the invention more securely in their open positions so they can not be accidentally dislodged from those positions. In the embodiment shown, stop 52 is comprised of two leaves facing each other that are sufficiently stiff to hold leg 32 in its open position, but flexible enough to move apart to allow the leg to move into that open position, or to move out of that position, under pressure from the user of the tray. The outer ends 54 of pressure-actuatable stop 52 are flared away from each other to make it easier to move leg 32 between the two leaves and into its open position.

As shown in FIG. 6, when legs 32 are in their open positions, they hold the tray at a predetermined height above the surface, such as a bed, sofa, cot, table top, floor or ground on which the legs are supported.

Cammed Latch

Each "U"-shaped leg 32 of the combination tray of this invention has a bight portion 38 that is normally stiff but is resiliently bendable under pressure. As seen in FIG. 2, when legs 32 are in their closed positions, they are held securely by cammed latch 40.

In the embodiment shown, latch 40 is spherical in shape. Hemispherical surfaces 42 and 44 on each side of ball-shaped latch 40 face toward an end of elongated tray frame 22.

Figure 3:
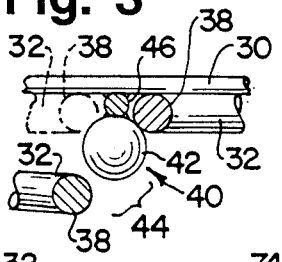
FIG. 3 is a fragmentary sectional view taken along the line 3—3 in FIG. 2, showing on the left hand the bight portion of one of the "U"-shaped leg in a position approaching its closed position, and on the right hand the bight portion of the other "U"-shaped leg in its final, closed position.

When resiliently bendable bight portion 38 of leg 32 that is hinged at the right end of the tray shown in FIG. 2 is bent to the right, it will be seen that it can slide past the hemispherical surface 42, which holds leg 32 in place when it is in its closed position such as shown in plan in FIG. 2 and in section in FIG. 3.

The reverse operation can be envisioned from FIG. 2, and is shown specifically in FIG. 3 for leg 32 that is partially shown on the left-hand side of FIG. 2. As will be seen in FIG. 3, hemispherical camming surface 44 facing to the left is in a position to engage bight portion 38 of this "U"-shaped leg 32 when the leg is swung up from its open position and approaches its closed position shown in phantom. Camming surface 44 is configured to bend resiliently bendable bight portion 38 of the left-hand hinge to the left as that portion (1) is pushed by the user of the tray toward the bottom of the support member formed by array of wires 30, (2) slides across the camming surface, and (3) after riding over the camming surface, snaps back to its normal shape as shown in phantom in FIG. 3, to hold leg 32 in its closed position beneath wires 30.

Camming surfaces 42 and 44 may advantageously be any other curviliner surface that is configured to interact with bight portion 38 of leg 32 as just described. If desired, the camming surfaces may be flat, slanting surfaces, so long as they produce the interaction with the hinge bight portions just described.

In the embodiment shown, cammed latch 40 is carried by cross member 46 that is secured at each end to base rod 28. Any other suitable mounting of the cammed latch may be employed.

Extensible Handles

As stated above, handles 24 and 26 for combination tray 20 are extensible from a closed position to an open position. The closed position is shown in FIGS. 1 and 6, and (in full lines) in FIG. 2. The open position is shown in FIG. 7 and (in dashed lines) in FIG. 2.

As seen, handles 24 and 26 extend outward at each end of elongated tray 20. Each handle is generally "U"-shaped. The free ends of the two legs of each "U"-shaped handle are slidably received in guide channels 56, which are mounted on the sides of the tray. As will be seen, this slidable mounting of the handles permits them to be moved outward from the ends of elongated tray frame 22 into open positions 58 at a predetermined maximum distance from the tray ends. When desired, handles 24 and 26 may be slid back through guide channels 56 into the closed positions shown in FIGS. 1, 2 and 6.

Each handle has associated with it a stop configured to prevent the handle from moving outward more than the predetermined maximum distance. As seen from the drawing, the stop means for handle 26 on the right-hand side of FIG. 2, for example, may comprise extender 60, attached at midpoint 62 of the handle, with plug or cap 64 secured to the free end of the extender. (For clarity, stop 60/64 is omitted from FIGS. 1 and 6.)

Extender 60 passes from outside tray frame 22 through aperture 66 in the end wall of the frame, with plug 64 in the interior of the frame. As best seen in FIG. 2, plug 64 which has a transverse cross-sectional area that is larger than aperture 66, will stop the outward movement of handle 26 when the handle reaches the predetermined maximum distance from the end of the tray frame. As pointed out above, this construction eliminates the safety hazard that would be created if the handle could be pulled entirely away from the tray.

In the embodiment illustrated, handles 24 and 26 and their associated guide channels 56 are positioned at a level just below the level of the support member formed of wire array 30. This places extender rod 60 and plug 64 in an out-of-the-way position below the support member.

Any other suitable stop may be employed to limit the outward movement of the two handles.

To prevent the handles from abutting tray frame 22 when the handles are in their closed positions, any suitable stop may be provided. In the embodiment shown, this stop comprises reentrant bends 68 at each outer end of the bight portion of the "U"-shaped handle. As best seen in FIG. 2, reentrant bends 68 prevent the handle from abutting tray frame 22 when the handle means is in its closed position, thereby protecting the user's fingers against being caught between the tray frame and the handle.

FIG. 7 illustrates how the combination tray of this invention can be used to advantage in a bathtub 70. With handles 24 and 26 extended as shown, they provide secure support for tray 20 on side walls 72 of the tub.

For one thing, the width of each handle, as it lies along the length of the tub side wall, is equal to a substantial portion of the width of the tray. As shown in FIG. 2, in this embodiment handle 26 is a little more than three-quarters of the tray width. Satisfactory results are obtained when the width of each handle is at least about one-quarter of the tray width, improved results are obtained if the handles are each at least about one-half the tray width, and it is preferred that the handles each be at least about three-quarters of the tray width. The handles may be as much as the full tray width if some form of stop other than reentrant bends 68 is used to prevent catching the user's finger between the tray and a handle in its closed position.

For another thing, in its fully extended position, a sufficient part of the inner end portion 74 of each leg of the "U"-shaped handle remains engaged with its associated guide channel 56 that the tray will be stably supported upon the tub walls.

Modern bathtub installations often leave only a narrow lip (referring to the horizontal flat top edge of the tub wall) at the bathroom wall side of the tub. This lip may in some cases be only a fraction of an inch. Regardless of the dimension of the lip, handles 24 and 26 are designed to rest on it, to provide the necessary stability when the tray is used as a bathtub tray.

Tray Edge and Skirt

As best seen in FIGS. 1, 6 and 7, a portion of elongated tray frame 22 extends a distance above the support member formed of an array of wires 30. This upwardly extending portion of tray 22 forms edge 76 extending around the perimeter of the tray, which keeps articles supported on the tray from sliding off. In addition, bottom edge portion 78 of elongated tray 22 preferably extends a distance below the support member formed of wire array 30, to form a skirt extending around the perimeter of the tray.

The substantial vertical dimension of elongated frame 22 represented by portions 76 and 78 results in two advantages. First, when one side wall 72 of the bathtub with which the tray is used is of a narrow width because it is partially hidden by the adjacent bathroom wall, bottom edge portion 78 is capable of being locked against either side wall of the tub for added stability. This abutment of the frame of the tray against one wall of the bathtub to provide additional stability to the tray is accomplished by adjusting the portion of one of the handles (either the handle next to the bathroom wall or the opposite handle) that remains within its associated guide channel 56. Second, the downwardly extending skirt 78 conceals legs 32 and their associated hinges 34/36 from view when the legs are in their closed positions, as well as guarding against accidental dislodgment of the legs from those positions.

While the present invention has been described in connection with the best mode presently contemplated by the inventors for carrying out their invention, the preferred embodiment described and shown is for purposes of illustration only, and is not to be construed as constituting any limitation of the invention. Modifications will be obvious to those skilled in the art, and all modifications that do not depart from the spirit of the invention are intended to be included within the scope of the appended claims.

We claim:

1. A combination serving tray, bed tray and bathtub tray which comprises:

(a) an elongated tray providing a support surface for objects to be placed on the tray;

(b) a "U"-shaped leg hinged at each end of the tray to swing from a closed position located underneath the tray, in which position the leg is substantially parallel to the bottom surface of the tray, downward into a vertical position and then beyond into an over-center, open position, in which position the leg is generally upright, said "U"-shaped leg having a bight portion that is normally stiff but is resiliently bendable under pressure;

(c) stop means for each of said "U"-shaped legs, said stop means being configured to limit the leg from moving beyond said over-center, open, generally upright position, in which position the two "U"-shaped legs hold the tray at a predetermined height above the surface on which the legs are supported;

(d) latch means located on the underside of the tray, said latch means including a camming surface associated with each of said "U"-shaped legs, each of said camming surfaces facing an end of the tray in a position to engage the resiliently bendable bight portion of its associated "U"-shaped leg when the leg is swung up from its open position to its closed position, said camming surface being configured to bend said bight portion of the leg as the bight portion (i) is pushed toward the bottom of the tray by the user of the tray, (ii) slides across said camming surface, and (iii) after riding over the camming surface, snaps back to its normal shape to hold the leg in its closed position beneath the tray;

(e) handle means extending outward at each end of the elongated tray, each of said handle means being slidably engaged with the tray and movable outward from a closed position into an open position that is located at a predetermined maximum distance from the end of the tray from which it extends, the width of each handle means being equal to a substantial portion of the width of the tray; and (f) stop means associated with each of the handle means, each of said stop means being configured to prevent its associated handle means from moving outward more than said predetermined maximum distance.

2. The combination serving tray, bed tray and bathtub tray of claim 1 in which each of the camming surfaces of the latch means is a curvilinear surface.

3. The combination serving tray, bed tray and bathtub tray of claim 2 in which the latch means has a hemispherical surface on each side that faces toward an end of the elongated tray.

4. The combination serving tray, bed tray and bathtub tray of claim 3 which includes a cross member at the bottom of the tray extending across from side to side of the tray, said latch means being carried by the cross member.

5. The combination serving tray, bed tray and bathtub tray of claim 1 which includes pressure-actuatable stop means configured to hold the "U"-shaped legs in their open positions and, when desired, to release the legs under pressure that is applied by the user directed towards the center of the elongated tray.

6. The combination serving tray, bed tray and bathtub tray of claim 1 in which each of said handle means is generally "U"-shaped, guide channels are provided on the elongated tray to slidably receive the free ends of the two legs of each "U"-shaped handle means, and stop means are provided to prevent the two handle means from abutting the ends of the tray when the handle means are in their closed positions.

7. The combination serving tray, bed tray and bathtub tray of claim 6 in which said last mentioned stop means comprise reentrant bends in the legs of each handle means, said bends being located at the outer ends of the bight portion of the "U"-shaped handle means.

8. The combination serving tray, bed tray and bathtub tray of claim 6 in which:

(a) the two handle means and their associated guide channels are located at a level just below the bottom surface of the tray; and (b) the stop means that prevents each handle from moving outward more than the predetermined maximum distance includes an extender member that projects inward from the handle, passes through an aperture in the end of the tray, and carries at its inner end a stop having a transverse cross-sectional area larger than said aperture.

9. The combination serving tray, bed tray and bathtub tray of claim 1 in which the width of each handle means is equal to at least about one-quarter of the width of the tray.

10. The combination serving tray, bed tray and bathtub tray of claim 1 in which the width of each handle means is equal to at least about one-half of the width of the tray.

11. The combination serving tray, bed tray and bathtub tray of claim 1 in which the width of each handle means is equal to at least about three-quarters of the width of the tray.

12. The combination serving tray, bed tray and bathtub tray of claim 1 which includes an elongated frame that extends around the perimeter of the tray and extends a distance above the upper surface of the tray to form a generally vertical edge member around the perimeter of the tray.

13. The combination serving tray, bed tray and bathtub tray of claim 12 in which the tray frame also extends below the tray to form a skirt.

14. The combination serving tray, bed tray and bathtub tray of claim 6 which includes an elongated frame extending around the perimeter of the tray, and the surface for supporting objects to be placed on the tray is provided by an array of parallel, spaced wires secured to said elongated tray frame.

15. A combination serving tray, bed tray and bathtub tray which comprises:

(a) an elongated tray providing a support surface for objects to be placed on the tray;

(b) a "U"-shaped leg hinged at each end of the tray to swing from a closed position located underneath the tray, in which position the leg is substantially parallel to the bottom surface of the tray, downward into a vertical position and then beyond into an over-center, open position, in which position the leg is generally upright, said "U"-shaped leg having a bight portion that is normally stiff but is resiliently bendable under pressure;

(c) stop means for each of said "U"-shaped legs, said stop means being configured to limit the leg from moving beyond said over-center, open, generally upright position, in which position the two "U"-shaped legs hold the tray at a predetermined height above the surface on which the legs are supported;

(d) latch means in the form of a spherical ball located on the underside of the tray, said latch means providing a camming surface associated with each of said "U"-shaped legs, each of said camming surfaces facing an end of the tray in a position to engage the resiliently bendable bight portion of its associated "U"-shaped leg when the leg is swung up from its open position to its closed position, said ball being positioned to bend said bight portion of the leg as the bight portion (i) is pushed toward the bottom of the tray by the user of the tray, (ii) slides across the ball, and (iii) after riding over the ball, snaps back to its normal shape to hold the leg in its closed position beneath the tray;

(e) handles extending outward at each end of the elongated tray, each of said handles being generally "U"-shaped, the width of each handle means being equal to a substantial portion of the width of the tray;

(f) a guide channel on each side of the elongated tray to slidably receive the free ends of the two legs of each "U"-shaped handle, each handle being movable outward in said channel from a closed position into an open position that is located at a predetermined maximum distance from the end of the tray from which it extends;

(g) stop means associated with each of the handles to prevent the handle from moving outward more than said predetermined maximum distance;

(h) reentrant bends in the legs of each handle, said bends being located at the outer ends of the bight portion of the "U"-shaped handle means, to prevent the two handles from abutting the ends of the tray when the handles are in their closed positions; and (i) an edge member around the perimeter of the tray extending above the top surface of the tray, and also extending below the bottom of the tray to form a skirt around the tray.

16. In a combination serving tray, bed tray and bathtub tray, the subcombination which comprises:

(a) an elongated tray frame providing a support surface for objects to be placed on the tray;

(b) a "U"-shaped leg hinged at each end of the tray to swing from a closed position located underneath the tray frame, in which position the leg is substantially parallel to the bottom surface of the tray, downward into a vertical position and then beyond into an over-center, open position, in which position the leg is generally upright, said "U"-shaped leg having a bight portion that is normally stiff but is resiliently bendable under pressure;

(c) stop means for each of said "U"-shaped legs, said stop means being configured to limit the leg from moving beyond said over-center, open, generally upright position, in which position the two "U"-shaped legs hold the tray at a predetermined height above the surface on which the legs are supported; and (d) latch means located on the underside of the tray, said latch means including a camming surface associated with each of said "U"-shaped legs, each of said camming surfaces facing an end of the tray in a position to engage the bight portion of its associated "U"-shaped leg when the leg is swung up from its open position to its closed position, said camming surface being configured to bend said resiliently bendable bight portion of the leg as the bight portion (i) is pushed toward the bottom of the tray by the user of the tray, (ii) slides across said camming surface, and (iii) after riding over the camming surface, snaps back to its normal shape to hold the leg in its closed position beneath the tray.

17. The subcombination of claim 16 in which the latch means has a hemispherical surface on each side that faces toward an end of the elongated tray.

* * * * *